United States Patent [19]

deNora

[11] 4,340,452

[45] Jul. 20, 1982

[54] NOVEL ELECTROLYSIS CELL

[75] Inventor: Oronzio deNora, Milan, Italy

[73] Assignee: Oronzio deNora Elettrochimici S.p.A., Milan, Italy

[21] Appl. No.: 151,346

[22] Filed: May 19, 1980

Related U.S. Application Data

[63] Continuation-in-part of Ser. No. 102,629, Dec. 11, 1979.

[30] Foreign Application Priority Data

Jan. 28, 1980 [IT] Italy ..... 19592 A/80

[51] Int. Cl.[3] ..... C23B 1/34; C23B 1/02; C23B 9/00

[52] U.S. Cl. ..... 204/129; 204/98; 204/128; 204/263; 204/266; 204/283; 204/296

[58] Field of Search ..... 204/98, 128, 129, 282-283, 204/257-258, 263, 205-266, 296

[56] References Cited

U.S. PATENT DOCUMENTS

| | | | |
|---|---|---|---|
| 4,056,452 | 11/1977 | Campbell | 204/282 |
| 4,191,618 | 3/1980 | Coker et al. | 204/128 |
| 4,253,922 | 3/1981 | Welch | 204/98 |

*Primary Examiner*—R. L. Andrews

*Attorney, Agent, or Firm*—Hammond & Littell, Weissenberger and Muserlian

[57] ABSTRACT

An electrolysis cell comprising a cell housing containing at least one set of gas and electrolyte permeable electrodes, respectively an anode and a cathode separated by an ion permeable diaphragm or membrane, means for introducing an electrolyte to be electrolyzed, means for removal of electrolysis products and means for impressing an electrolysis current thereon, at least one of the electrodes being pressed against the diaphragm or membrane by a resiliently compressible layer co-extensive with the electrode surface, said layer being compressible against the diaphragm while exerting an elastic reaction force onto the electrode in contact with the diaphragm or membrane at a plurality of evenly distributed contact points and being capable of transferring excess pressure acting on individual contact points to less charged adjacent points laterally along any axis lying in the plane of the resilient layer whereby the said resilient layer distributes the pressure over the entire electrode surface, the said resilient layer having an open structure to permit gas and electrolyte flow therethrough and a novel method of generating halogen by electrolysis of a halide containing electrolyte.

63 Claims, 9 Drawing Figures

FIG. 4
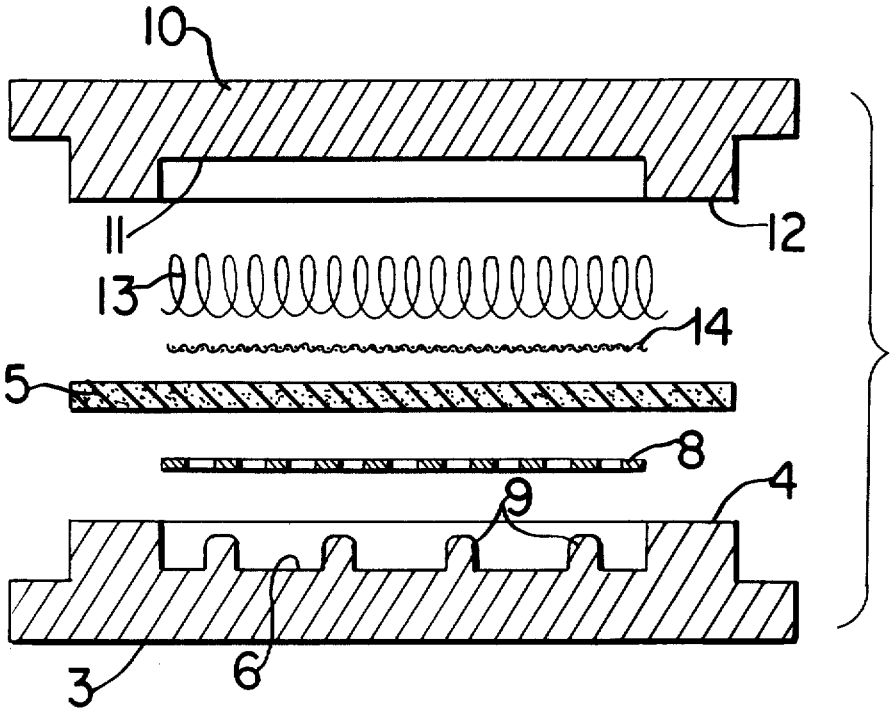
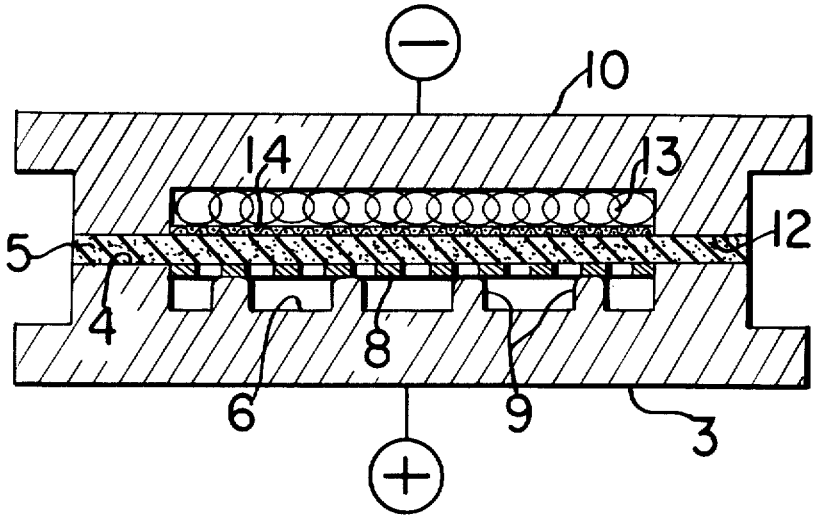
FIG. 5

FIG. 6
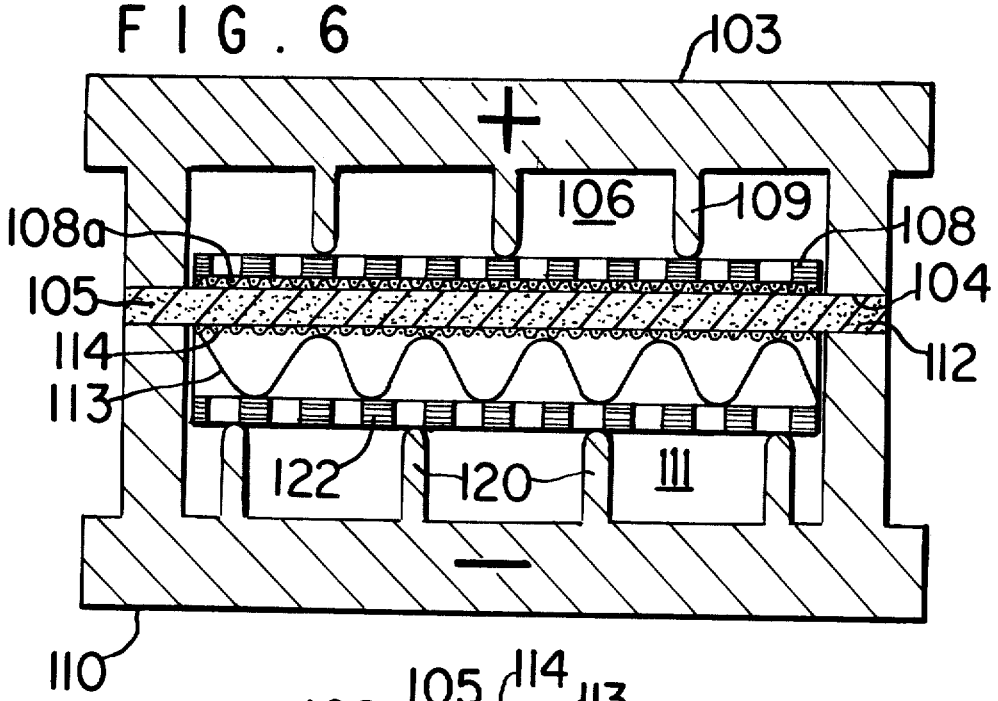
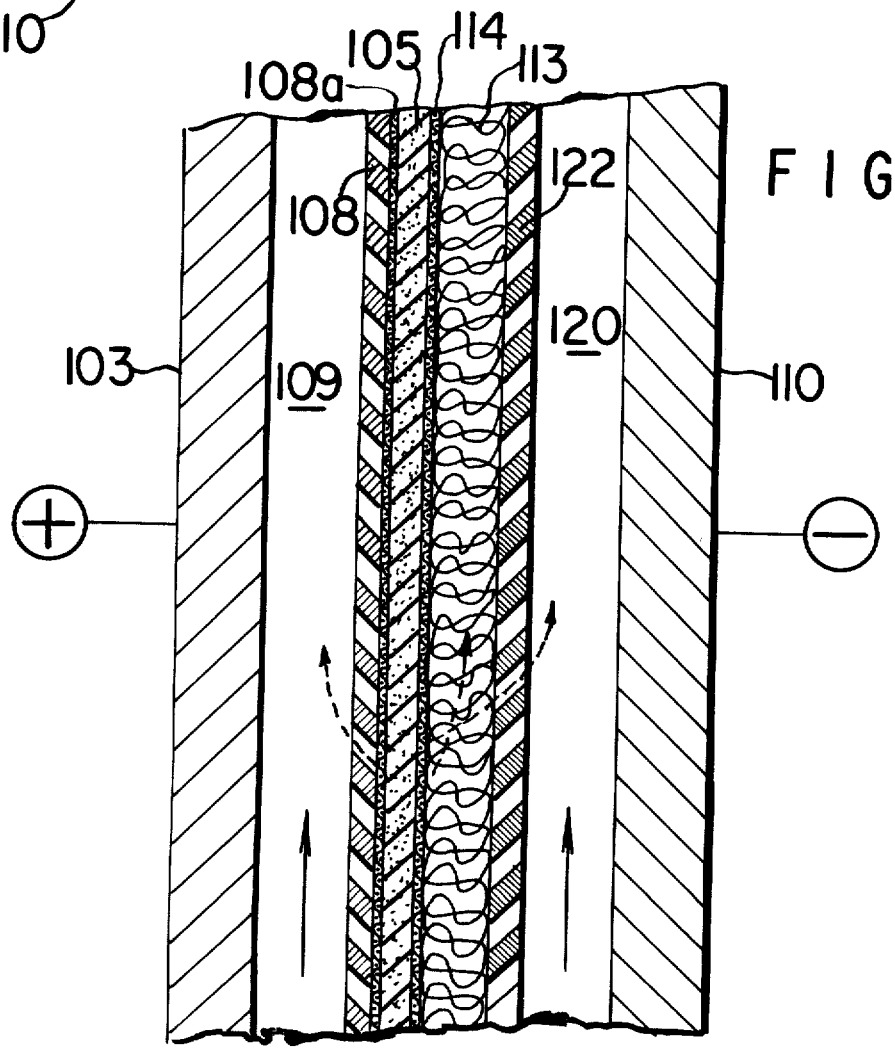
FIG. 7

NOVEL ELECTROLYSIS CELL

PRIOR APPLICATION

This application is a continuation-in-part of my copending, commonly assigned U.S. patent application Ser. No. 102,629 filed Dec. 11, 1979.

STATE OF THE ART

The generation of chlorine or other halogen by electrolysis of an aqueous halide such as hydrochloric acid and/or alkali metal chloride or other corresponding electrolysable halide has been known for a long time. Such electrolysis is usually in a cell in which the anode and the cathode are separated by an ion permeable membrane or diaphragm. In cells having a liquid permeable diaphragm, the alkali metal chloride is circulated through the anolyte chamber and a portion thereof flows through the diaphragm into the catholyte. When alkali metal chloride is electrolyzed, chlorine is evolved at the anode and alkali which may be alkali metal carbonate or bicarbonate but more commonly is alkali metal hydroxide solution is formed at the cathode.

This alkali solution also contains alkali metal chloride which must be separated from the alkali in a subsequent operation. The alkali solution is relatively dilute, rarely being in excess of 12–15% alkali by weight, and since commercial concentrations of sodium hydroxide normally are about 50% or higher by weight, the water in the dilute solution has to be evaporated to achieve this concentration.

More recently, considerable study has been undertaken with respect to the use of ion exchange resins or polymers as the ion permeable diaphragm. These polymers are in the form of thin sheets or membranes and generally they are imperforate and do not permit flow of anolyte into the cathode chamber. However, it has also been suggested that such membranes may have some small perforations to permit a small flow of anolyte therethrough although the majority of the work appears to have been accomplished with imperforate membranes.

Typical polymers which may be used for this purpose include fluorocarbon polymers such as polymers of an unsaturated fluorocarbon. For example, polymers of trifluoroethylene or tetrafluoroethylene or copolymers thereof which contain ion exchange groups are used for this purpose. The ion-exchange groups normally are cationic groups including sulfonic, sulfonamide, carboxylic, phosphoric groups and the like which are attached to the fluorocarbon polymer chain through carbon and which will exchange cations. However, they may also contain anion exchange groups. Thus, they have the general structure:

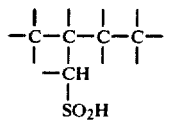

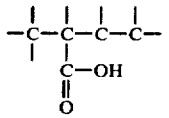

Typically, such membranes are those manufactured by the Du Pont Company under the trade name "Nafion" and by Asahi Glass Co. of Japan under the tradename "Flemion". Patents describing such membranes include Brit. Pat. No. 1,184,321, U.S. Pat. No. 3,282,875 and No. 4,075,405.

Since these diaphragms are ion permeable but do not permit anolyte flow therethrough, little or no halide ion migrates through the diaphragm of such a material in an alkali metal chloride cell and therefore, the alkali thus produced contains little chloride ions. Furthermore, it is possible to produce a more concentrated alkali metal hydroxide wherein the catholyte produced may contain from 15% to 40% of NaOH by weight or even higher. Patents describing such a process include U.S. Pat. No. 4,111,779 and No. 4,100,050 and many others. The application of an ion exchange membrane as an ion permeable diaphragm has also been proposed for other uses such as in water electrolysis.

My copending, U.S. patent application Ser. No. 102,629 describes the electrolysis of alkali metal chloride by conducting the electrolysis in a cell having a membrane or diaphragm which is ion permeable and in which the electrodes are in contact with the opposite sides of the diaphragm which is ion permeable. The entire disclosure of said earlier application is incorporated herein by reference.

OBJECTS OF THE INVENTION

It is an object of the invention to provide a novel electrolysis cell with an ion permeable membrane or diaphragm between an anode and a cathode with at least one electrode having gas and electrolyte permeable surface held in contact with the diaphragm by a resiliently compressible layer.

It is another object of the invention to provide a novel process for producing halogens by electrolysis of an aqueous halide containing solution with excellent results.

These and other objects and advantages of the invention will become obvious from the following detailed description.

THE INVENTION

The novel electrolysis cell of the invention is comprised of a cell housing containing at least one set of gas and electrolyte permeable electrodes, respectively an anode and a cathode separated by an ion permeable diaphragm or membrane, means for introducing an electrolyte to be electrolyzed, means for removal of electrolysis products and means for impressing an electrolysis current thereon, at least of the electrodes being pressed against the diaphragm or membrane by a resiliently compressible layer co-extensive with the electrode surface, said layer being compressible against the diaphragm while exerting an elastic reaction force onto the electrode in contact with the diaphragm or membrane at a plurality of evenly distributed contact points and being capable of transferring excess pressure acting on individual contact contact points to less charged adjacent points laterally along any axis lying in the plane of the resilient layer whereby the said resilient layer distributes the pressure over the entire electrode surface, the said resilient layer having an open structure to permit gas and electrolyte flow therethrough.

The novel method of the invention for generating halogen comprises electrolyzing an aqueous halide containing electrolyte at an anode separated from a cathode by an ion-permeable diaphragm or membrane and an aqueous electrolyte at the cathode, at least one of said anode and cathode having a gas and electrolyte permeable surface held in direct contact at a plurality of points with the diaphragm or membrane by an electroconductive, resiliently compressible layer open to electrolyte and gas flow and capable of applying pressure to the said surface and distributing pressure laterally whereby the pressure on the surface of the diaphragm or membrane is uniform.

In one embodiment of the invention, at least one of the electrodes is comprised of a conductive and gas and electrolyte permeable layer of particles of electrically conductive materials such as platinum group metals or oxides thereof, either as such or mixed with graphite particles, bonded to or otherwise incorporated on the membrane surface. Polarity is imparted to this bonded electrode by applying thereto a readily compressible sheet, mat or layer preferably of interlaced undulated wire strands which extend along a major part and usually substantially all of the surface of the electrode layer bonded to the membrane.

In accordance with a further embodiment, the bonded electrode may be dispensed with and the electroconductive, compressible mat or wire sheet may be pressed directly against the diaphragm and act as the electrode. Alternatively and more advantageously, an open mesh screen, usually finer in mesh or pore size than the compressible layer and preferably more flexible and less compressible is interposed between the compressible mat and the membrane. In either case, an open mesh layer bears against and is compressed against the membrane with the opposite or counter electrode, or at least a gas and electrolyte permeable surface thereof, being pressed against the opposite side of the diaphragm. Since the compressible layer and the finer screen, if present, are not bonded to the membrane, it is slideably moveable along the membrane surface and therefore can readily adapt to the contours of the membrane and the counter electrode.

This compressible layer is pliable and spring-like in character and while capable of being compressible to a reduction of up to 60 percent or more of its uncompressed thickness against the membrane by application of pressure from a backwall or pressure member, it is also capable of springing back substantially to its initial thickness upon release of the clamping pressure. Thus, by its elastic memory, it applies and maintains substantially uniform pressure against the membrane carrying the electrode layer since it is capable of distributing pressure stress and of compensating for irregularities in the surfaces with which it is in contact. It is flexible enough to bend in all directions and to assume the contours of the membrane. The compressible sheet also should provide ready access of the electrolyte to the electrode and ready escape of the electrode products, whether gaseous or liquid from the electrode.

Thus, the compressible layer is open in structure and includes a large free volume. The resiliently compressible sheet is essentially electrically conductive on its surface, generally being made of a metal resistant to the electrochemical attack of the electrolyte in contact therewith and it thus distributes polarity and current over the entire electrode layer. It may directly engage the membrane or the bonded electrode on the membrane. Alternatively, and preferably, this electrically conductive, resiliently compressible sheet may have a pliable electroconductive screen of nickel, titanium, niobium or other resistant metal between the sheet or mat and the electrode layer or between the membrane and the mat.

This screen is a thin, foraminous sheet which readily flexes and accommodates for surface irregularities in the electrode surface. It may be a screen of fine net work or a perforated film but usually, it is of finer mesh and is more pliable than the compressible layer and less compressible or substantially non-compressible.

A preferred embodiment of the resilient current electrode of the present invention is characterized in that it consists of a substantially open mesh, planar, electroconductive metal-wire article or screen having an open network and is comprised of wire or fabric resistant to the electrolyte and the electrolysis products and in that some or all of the wires form a series of coils, waves or crimps or other undulating contour whose diameter or amplitude is substantially in excess of the wire thickness and preferably corresponds to the article thickness, along at least one directrix parallel to the plane of the article. Of course such crimps or wrinkles are disposed in the direction across the thickness of the screen.

These wrinkles in the form of crimps, coils, waves or the like have side portions which are sloped or curved with respect to the axis normal to the thickness of the wrinkled fabric so that, when the collector is compressed, some displacement and pressure is transmitted laterally so as to make distribution of pressure more uniform over the electrode area or surface. Some coils or wire loops which, because of irregularities on the planarity or parallelism of the surface compressing the fabric, may be subjected to a compressive force greater than that acting on adjacent areas and they are capable of yielding more to discharge the excess force by transmitting it to neighboring coils or wire loops. Therefore, the fabric is effective in acting as a pressure equalizer to a substantial extent and in preventing the elastic reaction force from acting on a single contact point to exceed the limit whereby the membrane is excessively pinched or pierced. Of course, such self adjusting capabilities of the resilient collector are instrumental in obtaining a good and uniform contact distribution over the entire surface of the electrode.

One very effective embodiment desirably consists of a series of helicoidal cylindrical spirals of wire whose coils are mutually wound with the one of the adjacent spiral in an intermeshed or interlooped relationship. The spirals are of a length substantially corresponding to the height or width of the electrodic chamber or at least 10 or more centimeters in length and the number of intermeshed spirals is sufficient to span the whole width thereof. The diameter of the spirals is 5 to 10 or more times the diameter of the wire of the spirals. According to this preferred arrangement, the wire helix itself represents a very samll portion of the section of the electrodic chamber enclosed by the helix and therefore the helix is open on all sides thereby providing an interior channel to permit circulation of the electrolyte and the rise of the gas bubbles along the chamber.

It is not, however, necessary for the helicoidal cylindrical spirals to be wound in an intermeshed relationship with the adjacent spirals as previous described, and they may also consist of single adjacent metal wire spirals. In this case, the spirals are juxtaposed one beside another with the respective coils being merely engaged in an alternate sequence. In this manner, a higher contact point density may be achieved with the cooperating planes represented by the counter electrode or counter current collector and the cell end-plate.

According to a further embodiment, the current collector consists of a crimped knitted mesh or fabric of metal wire wherein every single wire forms a series of waves of an amplitude corresponding to the maximum height of the crimping of the knitted mesh or fabric. Every metal wire thus contacts in an alternate sequence the cell end-plate which serves as the plate applying the pressure and the electrode bonded on the membrane surface or the intermediate flexible screen interposed between the electrode and the compressible layer. At least a portion of the mesh extends across the thickness of the fabric and is open to electrolyte flow in an edgewise direction. As an alternative, two or more knitted meshes or fabrics, after being individually crimped by forming may be superimposed one upon another to obtain a collector of the desired thickness.

The crimping of the metal mesh or fabric imparts to the collector a great compressibility and an outstanding resiliency to compression under a load which may be at least about 50–2000 grams per square centimeter ($g/cm^2$) of surface applying the pressure i.e. the back-or-end-plate.

The electrode of the invention, after assembly of the cell, has a thickness preferably corresponding to the depth of the electrodic chamber. However, the depth of the chamber may conveniently be made larger and in this instance, a foraminous and substantially rigid screen or a plate spaced from the surface of the back-wall of the chamber may act as the compressing surface against the compressible resilient collector mat. The space behind the at least relatively rigid screen is open and provides an electrolyte channel through which evolved gas and electrolyte may flow.

The mat is capable of being compressed to a much lower thickness and volume. For example, it may be compressed to about 50 to 90 percent or even lesser percent of its initial volume and/or thickness and is, therefore, pressed or compressed between the membrane and the conducting back-plate of the cell by clamping these members together. The compressible sheet is moveable i.e. it is not welded or bonded to the cell end-plate or interposed screen and transmits the current essentially by mechanical source and with the electrode.

Thus the mat is moveable or slideable with respect to the adjacent surfaces of these elements with which it is in contact. When clamping pressure is applied, the wire loops or coils constituting the resilient mat may deflect and slide laterally and distribute pressure uniformly over the entire surfaces with which it contacts. In this way, it functions in a maner superior to individual springs distributed over an electrode surface since the springs are fixed and there is no interaction between pressure points to compensate for surface irregularities of the bearing surfaces.

A large portion of the clamping pressure of the cell is elastically memorized by every single coil or wave of the metal wires forming the current collector. Since practically no severe mechanical strains are created by the differential elastic deformation of one or more single coils or crimps of the article, with respect to the adjacent ones, the resilient collector of the invention can effectively prevent or avoid the piercing or undue thinning of the membrane at the more strained points or areas during the assembly of the cells. Rather high deviations from the planarity of the current-carrying structure of the opposed electrode can be thus tolerated, as well as deviations from the parallelism between said structure and the cell back-plate or rear pressure plate.

The resilient electrode of the invention is advantageously the cathode and is associated with or opposed by an anode which may be of the more rigid type. This means that the electrode on the anode side may be supported more or less rigidly. In cells for the electrolysis of sodium chloride brines, the cathode mat or compressible sheet more desirably consists of a nickel or nickel-alloy wire or stainless steel because of the high resistance of these materials to caustic and hydrogen embrittlement. The mat may be coated with a platinum group metal or metal oxides, cobalt or oxides thereof or other catalysts to reduce hydrogen overvoltage. Any other metal capable of retaining its resilience during use including titanium optionally coated with a non-passivating coating such as for example a platinum group metal or oxide thereof may be used. The latter is particularly useful when used in contact with acidic anolytes.

As has been mentioned, a porous electrode layer of electrode particles of a platinum group metal or oxides thereof or other resistant electrodic material may be bonded to the membrane. This layer usually is at least about 40 to 150 microns in thickness and may be produced substantially as described in U.S. Pat. No. 3,297,484 and, if desired, the layer may be applied to both sides of the diaphragm. Since the layer is substantially continuous, although gas and electrolyte permeable, it shields the compressible mat and accordingly most, if not all, of the electrolysis occurs on the electrode layer with little, if any, electrolysis e.g. gas evolution, taking place on compressed mat which engages the back side of the layer. This is particularly true when particles of the layer have a lower hydrogen or chlorine overvoltage than the mat surface. In that case, the mat serves largely as a current distributor or collector distributing current over the lower conducting layer.

In contrast, thereto when the compressible mat directly engages the diaphragm or even when there is an intervening foraminous electroconductive screen or other perforate conductor between the mat and the diaphragm, the open mesh structure ensures the existence of unobstruded paths for electrolyte to rear areas which are spaced from the membrane including areas which may be on the front, the interior and on the rear portion of the compressible fabric. Thus the compressed mat, being open and not completely shielded, can itself provide active electrode surfaces which may be 2 to 4 or more times the total projected surface in direct contact with the diaphragm.

Some recognition of the increase in surface area of a multilayered electrode has been suggested in British Pat. No. 1,268,182 which describes a multilayered cathode comprising outer layers of expanded metal and inner layers of thinner and smaller mesh (which may be knitted mesh) with the cathode touching a cation exchange membrane with electrolyte flowing in an edgewise direction through the cathode.

According to the present invention, it has been found that lower voltage is achieved by recourse to a compressible mat which by virtue of crimping, wrinkling, curling or other design has a substantial portion of the wires or conductors which extend across the thickness of the mat a distance at least a portion of such thickness. Usually, these wires are curved so that as the mat is compressed, they bend resiliently thus distributing the pressure and these cross wires impart substantially the same potential to the wires in the rear as exists on the wires contacting the membrane.

When such a mat is compressed against the diaphragm, including or excluding any interposed screen, a voltage which is lower by 5 to 150 millivolts can be achieved at the same current flow than can be achieved when the mat or its interposed screen simply touches the diaphragm. This can represent a substantial reduction in kilowatt hour consumption per ton of chlorine evolved. As the mat is compressed, its portions which are spaced from the membrane approach, but remain spaced from the membrane, and the likehood and indeed extent of electrolysis thereon increases. This increase in surface area permits a greater amount of electrolysis without an excessive voltage increase.

There is also a further advantage even where little actual electrolysis takes place on the rear portions of the mat because the mat is better polarized against corrosion. For example, when a nickel compressible mat is butted against a continuous layer of electrode particles bonded to the diaphragm, shielding may be so great that little or no electrolysis takes place on the mat and in such a case, it has been observed that the nickel mat tended to corrode particularly when alkali metal hydroxide exceeded 15 percent by weight. With an open foraminous structure directly in contact with the diaphragm, enough open path to the spaced portions and even the rear of the mat is provided so that the exposed surfaces thereof at least become negatively polarized or cathodically protected against corrosion. This applies even to surfaces where no gas evolution or other electrolysis takes place. These advantages are especially notable at current densities above 1000 amperes per square meter of electrode surface measured by the total area enclosed by the electrode extremeties.

Preferably, the resilient mat is compressed to about 80 to 30 percent of its original uncompressed thickness under a compression pressure which is comprised between 50 and 2000 grams per square centimeter of projected area. Even in its compressed state, the resilient mat must be highly porous and the ratio between the voids volume and the apparent volume of the compressed mat expressed in percentage is advantageously at least 75% (rarely below 50%) and preferably is comprised between 85% and 96%. This may be computed by measuring the volume occupied with the mat compressed to the desired degree and weighing the mat. Knowing the density of the metal of the mat, its solid volume can be calculated by dividing the volume by the density which then gives the volume of the solid mat structure and the volume of voids is then obtained by substracting this figure from the total volume.

It has been found that when this ratio becomes exceedingly low, for example, by exceedingly compressing the resilient mat below 30% of its uncompressed thickness, the cell voltage begins to increase, probably due in part to a decrease in the rate of mass transport to the active surfaces of the electrode and/or the ability of the electrode system to allow adequate escape of evolved gas. A typical characteristic of cell voltage as function of the degree of compression and of the void's ratio is reported later in the examples.

The diameter of the wire utilized may vary within a wide range depending on the type of forming or texturing being low enough in any event to obtain the desired characteristics of resiliency and deformation at the cell-assembly pressure. An assembly pressure corresponding to a load between 50 and 500 g/cm$^2$ of electrodic surface is normally required to obtain a good electrical contact between the membrane-bonded electrodes and the respective current-carrying structures or collectors although higher pressures may be used.

It has been found that by providing a deformation of the resilient electrode of the invention of about 1.5 to 3 millimeters (mm) which corresponds to a compression not greater than 60% of the thickness of the non-compressed article, at a pressure of about 400 g/m$^2$ of projected surface, a contact pressure with the electrodes may be obtained within the above cited limits also in cells with a high surface development and with deviations from planarity up to 2 millimeters per meter (mm/m).

The metal wire diameter is preferably between 0.1 or even less and 0.7 millimeters while the thickness of the noncompressed article, that is, either the coils' diameter or the amplitude of the crimping is 5 or more times the area diameter, preferably in the range of 4 to 20 millimeters. Thus it will be apparent that the compressible section encloses a large free volume i.e. the proportion of occupied volume which is free and open to electrolyte flow and gas flow.

In the wrinkled (which includes these compressing wire helixes) fabrics described above, this percent of free volume is about 75% of the total volume occupied by the fabric and this percent of free volume rarely should be less than 25% and preferably should not be less than 50%. Pressure drop in the flow of gas and electrolyte through such a fabric is negligible.

When the use of particulated electrodes or other porous electrode layers directly bonded to the membrane surface is not contemplated, the resilient mat or fabric directly engages the membrane and acts as the electrode. It has now been surprisingly found that only a substantially negligeable cell voltage penalty with respect to the use of bonded electrode layers, can be achieved by providing a sufficient density of resiliently established contact points between the electrode surface and the membrane. The density of contact points should be at least about 30 points per square centimeters of membrane surface and more preferably it should be 100 points or more per square centimeter. Conversely, the contact area of single contact points should be as small as possible and the ratio of total contact area versus the corresponding engaged membrane area should be smaller than 0.6 and preferably smaller than 0.4.

In practice, it has been found convenient to use a pliable metal screen having a mesh of at least 10 (that is ten strands per inch), preferably above 20, and usually between 20 and 200 or a fine mesh expanded metal of similar characteristic interposed between the resiliently compressed mat and the membrane. It has been proven that under these conditions of minute and dense contacts, resiliently established between the electrode screen and the surface of the membrane, a major portion of the electrode reaction takes place at the contact interface between the electrode and the ion exchange groups contained in the membrane material; that is most of the ionic conduction takes place in and across the membrane and little or none takes place in the liquid electrolyte in contact with the electrode. For example, electrolysis of pure twice distilled water, having a resistivity of over 200,000 Ω.cm has been successfully effected in a cell of this type equipped with a cation exchange membrane at a surprisingly low cell voltage.

Moreover, when electrolysis of alkali metal brine is performed in the same cell, no appreciable change of cell voltage is experienced by varying the orientation of the cell from horizontal to vertical indicating that the contribution to the cell voltage drop attributable to the so called "bubble effect" is negligeable. This behavior is in good agreement with that of solid electrolyte cells having particulate electrodes bonded to the membrane which contrasts with that of traditional membrane cells equipped with coarse foraminous electrodes, either in contact or slightly spaced from the membrane, wherein the bubble effect has a great contribution to the cell voltage which is normally lower when the gas evolving foraminous electrode is kept horizontal below a certain head of electrolyte and is maximum when the electrode is vertical because of a reduction of the rate of gas disengagement and because of increasing gas bubble population along the height of the electrode due to accumulation.

An explanation of this unexpected behavior is certainly due in part to the fact that the cell behaves substantially as a solid electrolyte cell, that is the major portion of the ionic conduction takes place in the membrane, and also because of resiliently established contacts of extremely small individual contact areas between the fine mesh screen electrode layer and the membrane are capable of easily releasing the infinitesimal amount of gas which forms at the contact interface and to immediately re-establish the contact once the gas pressure is relieved.

The resiliently compressed electrode mat insures a substantially uniform contact pressure and a uniform and substantially complete coverage of high density minute contact points between the electrode surface and the membrane effectively acts as a gas release spring to maintain a substantially constant contact between the electrode surface and the functional ion exchange groups on the surface of the membrane which acts as the electrolyte of the cell.

Both electrodes of the cell may comprise a resiliently compressible mat and a fine mesh screen providing for a number of contacts over at least 30 contact points per square centimeter, respectively, made of materials resistant to the anolyte and to the catholyte. More preferably, only one electrode of the cell comprises the resiliently compressible mat of the invention associated with the fine mesh electrode screen while the other electrode of the cell may be a substantially rigid, foraminous structure, preferably also having a fine mesh screen interposed between the course rigid structure and the membrane.

Referring now to the drawings:

FIG. 4 is an exploded, sectional horizontal view of a cell of the invention having a typical compressible electrode system of the type herein contemplated wherein the compressible portion comprises helical spiral wires.

FIG. 5 is an horizontal cross-sectional view of the assembled cell of FIG. 4.

FIG. 6 is a diagrammatic, horizontal view of a further embodiment wherein the compressible electrode section comprises crimped mesh such as crimped knitted wire mesh.

FIG. 7 is a diagrammatic fragmentary vertical cross-section of the cell illustrated in FIG. 4.

Figure 1:
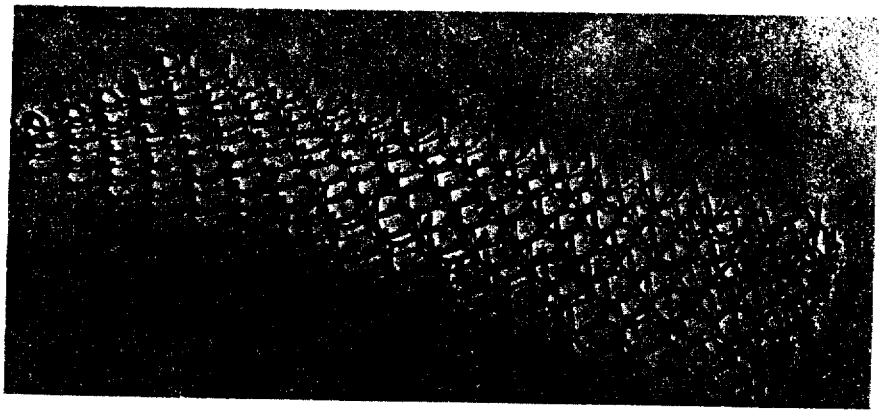
FIG. 1 is a photographic reproduction of an embodiment of a typical resiliently compressible mat used in the practice of this invention.
Figure 2:
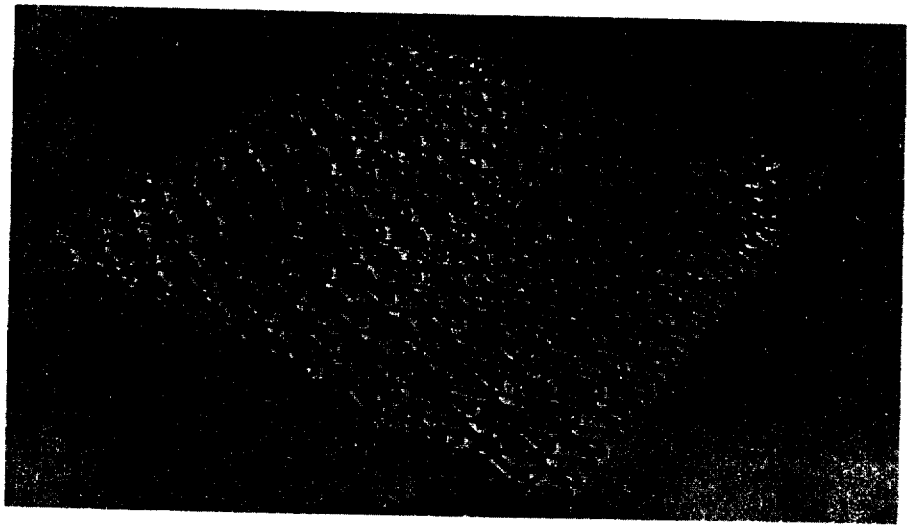
FIG. 2 is a photographic reproduction of another embodiment of the resiliently compressible mat which may be used according to this invention.
Figure 3:
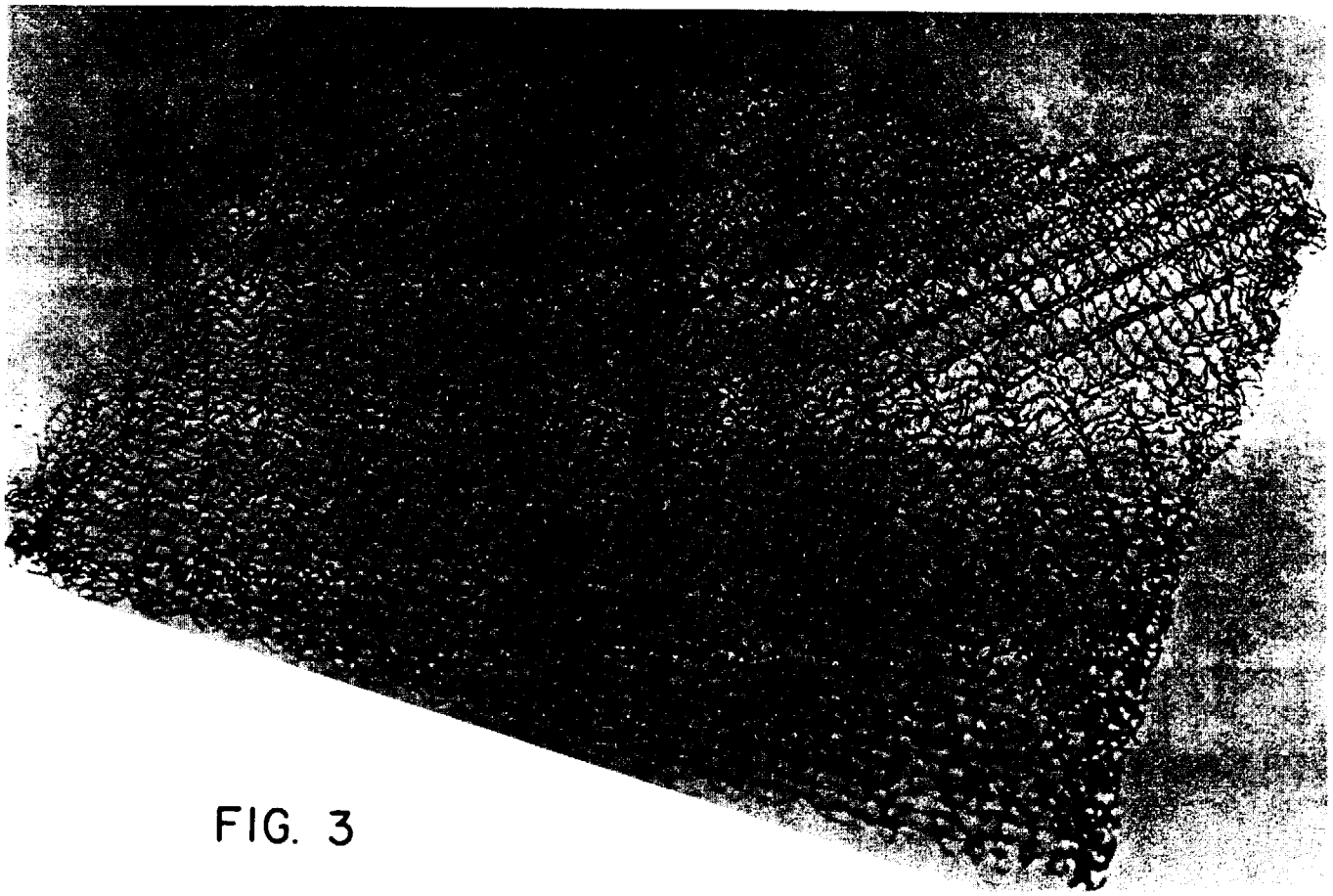
FIG. 3 is a photograph reproduction of a further embodiment of the resiliently compressible mat of the invention.

In FIG. 1, the compressible electrode or section thereof is comprised of a series of interlaced helicoidal cylindrical spirals consisting of a 0.6 mm or less diameter nickel wire, the cell being mutually wound one inside the adjacent one respectively as can be seen in FIG. 5 and having a coil diameter of 15 mm. A typical embodiment of the structure of FIG. 2 substantially comprises helicoidal spirals 2 having a flattened or eliptical section made with 0.5 mm diameter nickel-wire, their coils being mutually wound one inside the adjacent one, respectively, the minor axis of the helix being 8 mm. A typical embodiment of the structure of FIG. 3 consists of a 0.15 mm diameter nickel wire knitted mesh crimped by forming. The amplitude or height or depth of the crimping is 5 mm, with a pitch between the waves 5 mm. The crimping may be in the form of intersecting parallel crimp banks in the form of a herring bone pattern as shown in FIG. 3.

Referring to FIG. 4, the cell which is particularly useful in sodium chlorine brine electrolysis comprises a compressible electrode or current collector of the invention associated with a vertical anodic end-plate 3 provided with a seal surface 4 along the entire perimeter thereof to sealably contact the peripheral edges of the diaphragm or membrane 5 with the insertion, if desired, of a liquid impermable insulating peripheral gasket, not illustrated. The anodic end-plate 3 is also provided with a central recessed area 6 with respect to said seal surface, having a surface extending from a lower area where brine is introduced to a top area where spent or partially spent brine and evolved chlorine is discharged and these areas usually are in ready communication at the top and bottom. The end-plate may be made of steel with its side contacting the anolyte clad with titanium or another passivatable valve metal or it may be of graphite or mouldable mixtures of graphite and a chemically resistant resin binder or of other anodically resistant material.

The anode preferably consists of a gas and electrolyte permeable titanium, niobium or other valve metal screen or expanded sheet 8 coated with a non-passivatable and electrolysis-resistant material such as noble metals and/or oxides and mixed oxides of platinum group metals or other electrocatalytic coating, which serve as anodic surface when placed on a conductive substrate. The anode is substantially rigid and the screen is sufficiently thick to carry the electrolysis current from the ribs 9 without excessive ohmic losses. More preferably, a fine mesh pliable screen which may be of the same material as the coarse screen 8 is disposed on the surface of the coarse screen 8 to provide fine contacts with the membrane with a density of 30 or more, preferably 60 to 100, contact points per square centimeter of membrane surface. The fine mesh screen may be spot welded to the coarse screen or may just be sandwiched between screen 8 and the membrane. The fine mesh screen is coated with noble metals or conductive oxides resistant to the anolyte.

The vertical cathodic end-plate 10 presents on its inner side a central recessed zone 11 with respect to the peripheral seal surfaces 12 and said recessed zone 11 is substantially planar, that is ribless, and parallel to the seal surfaces plane. Inside said recessed zone of the cathodic end-plate, there is positioned the resilient compressible electrode element 13 of the invention, advantageously made of nickel-alloy. In the embodiment illustrated in FIG. 4, the electrode comprises an helix of the wire or a plurality of interlaced helixes. These helixes may engage the membrane directly. However, a screen 14 preferably is interposed as illustrated between the wire helix and the membrane. The helix and the screen slideably engage each other and the membrane.

The spaces between adjacent spirals of the helix should be large enough to ensure ready flow or movement of gas and electrolyte between the spirals, for example, into and out of the central areas enclosed by the helix. These spaces generally are substantially larger, often 3—5 times or larger, than the diameter of the wire.

The thickness of the non-compressed helical wire coil is preferably from 10% to 60% greater than the depth of the recessed central zone 11, with respect to the plane of the seal surfaces. During the assembly of the cell, the coil is compressed from 10% to 60% of its original thickness, thereby exerting an elastic reaction force, preferably in the range of 80–1000 g/cm$^2$ of projected surface. The cathodic end plate 10 may be made of steel or any other conductive material resistant to caustic and hydrogen.

The membrane 5 is preferably an ion-exchange membrane, fluid-impervious and cation-permselective, such as for example a membrane consisting of a 0.3 mm-thick polymeric film of a copolymer of tetrafluoroethylene and perfluorosulfonylethoxyvinylether having ion exchange groups such as sulfonic, carboxylic or sulfonamide groups. Because of its thinness it is relatively flexible and tends to sag, creep, or otherwise deflect unless supported. Such membranes are produced by E. I. Du Pont de Nemours under the trademark of "Nafion". The membranes are flexible ion exchange polymers capable of transporting ions. Normally, they have been boiled in an aqueous electrolyte such as acid or alkali metal hydroxide and thereby become highly hydrated, thus containing a considerable amount, 10–15% or more by weight, of water either combined as hydrate or simply absorbed.

The screen 14 conveniently may be of nickel wire or other convenient material capable of resisting corrosion under cathodic conditions. While it may have some rigidity, it preferably should be flexible and essentially non-rigid so that it can readily bend to accomodate the irregularities of the membrane cathodic surface. These irregularities may be in the membrane surface itself but more commonly are due to irregularities in the more rigid anode against which the membrane bears. Generally, the screen is more flexible than the helix.

For most purposes, the mesh size of the screen should be smaller than the size of the openings between the spirals of the helix. Screens with openings of 0.5 to 3 millimeters in width and length are suitable although the finer mesh screens are particularly preferred according to the preferred embodiment of the invention.

The intervening screen can serve a plurality of functions. First, since it is electroconductive, it presents an active electrode surface. Second, it serves to prevent the helix or other compressible electrode element from locally abrading, penetrating or thinning out the membrane. Thus, as the compressed electrode pressed against the screen in a local area, the screen helps to distribute the pressure along the membrane surface between adjacent pressure points and also prevents a distorted spiral section from penetrating or abrading the membrane.

In the course of electrolysis, hydrogen and alkali metal hydroxide are evolved on the screen and generally on some portion or even all of the helix. As the helical spirals are compressed, their rear surfaces i.e. those remote or spaced from the membrane surface approach the screen and the membrane and of course the greater the degree of compression, the lower the average space of the spirals from the membrane and the greater the electrolysis or at least cathodic polarization of the spiral surface. Thus, the effect of compression may be to increase the overall effective surface area of the cathode.

Compression of the electrode is found to effectively reduce the overall voltage required to sustain a current flow of 1000 Amperes per square meter of active membrane surface or more. At the same time, compression should be limited so the compressible electrode remains open to electrolyte and gas flow. Thus, as illustrated in FIG. 5, the spirals remain open to provide central vertical channels through which electrolyte and gas may rise. Furthermore, the spaces between spirals remain spaced to permit access of catholyte to the membrane and the sides of the spirals. The wire of the spirals generally is small ranging from 0.05 to 0.5 millimeters in diameter. While larger wires are permissible, they tend to be more rigid and less compressible and thus, it is rare for the wire to exceed 1.5 mm.

FIG. 5 represents the cell of FIG. 4 in the assembled state wherein the parts corresponding to both drawings are labeled with the same numbers. As shown in this view, the end plates 3 and 10 have been clamped together thereby compressing the helical coil sheet or mat 13 against the electrode 14.

During the cell operation, the anolyte consisting, for example, of a saturated sodium chlorine brine is circulated through the anode chamber 7, more desirably feeding fresh anolyte through an inlet pipe, not illustrated, in the vicinity of the chamber bottom and discharging the spent anolyte through an outlet pipe, not illustrated, in the proximity of the top of said chamber together with the evolved chlorine. The cathode chamber 15 is fed with water or dilute aqueous caustic through an inlet pipe, not illustrated, at the bottom of the chamber, while the alkali produced is recovered as a concentrated solution through an outlet pipe, not illustrated, in the upper end of said cathode chamber 15. The hydrogen evolved at the cathode may be recovered from the cathode chamber, either together with the concentrated caustic solution or through another outlet pipe at the top of the chamber.

Because the mesh of the helix and the screens (if present) are open, there is little or no resistance to gas or electrolyte flow through the compressed electrode. The anodic and cathodic end-plates are both properly connected to an external electrical current source and the current passes through the series of ribs 9 to the anode.

The electrodes provide a plurality of contact points on the membrane with current ultimately flowing to the cathode end plate 10 through pluralities of contact points.

After assembly of the cell, the current collector 13 in its compressed state which entails a deformation, preferably between 10 and 60% of the original thickness of the article, that is of the single coils or crimps thereof, exerts an elastic reaction force against the cathode 14 surface and therefore against the restraining surface represented by the relatively more rigid indeed substantially non-deformable anode or anodic current collector 8. Such reaction force maintains the desired pressure on the contact points between the cathode and the membrane as well as the screen portion and the helical portion of the cathode.

Because the helix spirals and the screen are slideable with respect to each other and with respect to the membrane as well as the rear bearing wall, absence of mechanical restraints to the differential elastic deformation between adjacent spirals or adjacent crimps of the resilient electrode allows the same to adjust laterally to unavoidable slight deviation from planarity or parallelism between the cooperating planes represented by the anodic collector 8 and the bearing surface 11 of the cathode compartment, respectively. Such slight deviations normally occurring in standard fabrication processes may therefore be compensated for to a substantial degree.

The advantages of the resilient electrode of the invention are fully realized and appreciated in industrial filter press-type electrolyzers which comprises a great number of elementary cells clamped together in a series-arrangement to form modules of high production capacity. In this instance, the end-plates of the intermediate cells are represented by the surfaces of bipolar separators bearing the anode and cathode current collector on each respective surface. The bipolar separators, therefore, besides acting as the defining walls of the respective electrodic chambers, electrically connect the anode of one cell to the cathode of the adjacent cell in the series.

Thanks to their elevated deformability, the resilient compressible electrodes of the invention afford a more uniform distribution of the clamping pressure of the filter-press module on every single cell. This is particularly true when the opposite side of each membrane is rigidly supported as by relatively rigid anode 8. In such series cells, the use of resilient gaskets is recommended on the seal-surfaces of the single cell to avoid limiting the resiliency of the compressed filter-press module to the membranes resiliency. A greater advantage may be thus taken of the elastic deformation properties of the resilient collectors within each cell of the series.

FIG. 6 diagrammatically illustrates a further embodiment of the invention wherein a crimped fabric of interlaced wires is used as the compressible element of the electrode in lieu of helical spirals. Furthermore, an additional electrolyte channel is provided for electrolyte circulation. As shown, the cell comprises an anode end plate 103 and a cathode end plate 110 which are both mounted in a vertical plane and each end plate is in the form of a channel having side walls enclosing an anode space 106 and a cathode space 111. Each end plate also has a peripheral seal surface on a side-wall projecting from the plane of the respective end plate 104 being the anode seal surface and 112 being the cathode surface. These surfaces bear against a membrane or diaphragm 105 which stretches across the enclosed space between the side walls.

The anode 108 comprises a relatively rigid non-compressible sheet of expanded titanium metal or other perforate, anodically resistant substrate, preferably having a non-passivable coating thereon such as a metal or oxide or mixed oxide of a platinum group metal. This sheet is sized to fit within the side walls of the anode plate and is supported rather rigidly by spaced electroconductive metal or graphite ribs 109 which are fastened to and project from the web or base of the anode end plate 103. The spaces between the ribs provide for ready flow of anolyte which is fed into the bottom and withdrawn from the top of such spaces. The entire end plate and ribs may be graphite but alternatively, may be of titanium clad steel or other suitable material. The rib ends bearing against the anode sheet 108 may or not be coated e.g. with platinum to improve electrical contact. The anode steel 108 may be also welded to the ribs 109.

Thus the anode rigid foraminous sheet 108 is held firmly in an upright position. This sheet may be of expanded metal having upwardly including openings directed away from the membrane. (see FIG. 9) to deflect rising gas bubbles towards the spaces 106'.

More preferably, a fine mesh pliable screen **108*a* made of titanium or other valve metal coated with a non-passivable layer which may advantageously be a noble metal or conductive oxides having a low overvoltage for the anodic reaction (e.g. chlorine evolution), is disposed between the rigid foraminous sheet 108 and the membrane 105. The fine mesh screen 108*a* provides a density of contacts of extremely low area with the membrane in excess of at least 30 contacts per square centimeter and it may be spot welded to the coarse screen 108 or not. On the cathode side, ribs 120 extend outward from the base of the cathode end plate 110 a distance which is a fraction of the entire depth of the cathode space 111. These ribs are spaced across the cell to provide parallel spaces 111** for electrolyte flow. As in the embodiments discussed above, the cathode end plate and ribs may be of steel or a nickel iron alloy or other cathodically resistant material.

On to the conductive ribs 120 is welded a relatively rigid pressure plate 122 which is perforate and readily allows circulation of electrolyte from one side thereof to the other. Generally, these openings or louvers are inclined upward away from the membrane or compressible electrode toward the free space 111. (see also FIG. 7.) The pressure plate is electroconductive and serves to impart polarity to the electrode as well as to apply pressure thereto and it may be made of expanded metal or heavy screen of steel, nickel, copper or alloys thereof.

A relatively fine flexible screen 114 bears against the cathode side of the active area of the diaphragm 105 and because of its flexibility and relative thinness, it assumes the contours of the diaphragm and therefore that of the anode 108. This screen serves at least partly as the cathode and thus is electroconductive e.g. a screen of nickel wire or other cathodically resistant wire and which may have a surface of low hydrogen overvoltage. The screen preferably provides a density of contacts of extremely low area with the membrane in excess of at least 30 contact per square centimeter. A compressible mat 113 is disposed between the cathode screen 114 and the cathode pressure plate 122.

As illustrated in FIG. 6, the mat is comprised of a crimped or wrinkled wire mesh fabric which advantageously is open mesh knitted wire mesh of the type illustrated in FIG. 3 wherein wire strands are knitted into a relatively flat fabric with interlocking loops. This fabric is then crimped or wrinkled into a wave or undulating form with the waves being close together, for example, 0.3 to 2 centimeters apart, and the overall thickness of the compressible fabric is 5 to 10 millimeters. The crimps may be in a zig-zag or herringbone pattern as illustrated in FIG. 3 and the mesh of the fabric is coarser i.e. has a larger pore size, than that of the screens 114.

As illustrated in FIG. 6, this undulating fabric 113 is disposed in the space between the finer mesh screen 114 and more rigid expanded metal pressure plate 122. The undulations extend across the space and the void ratio of the compressed fabric is still preferably higher than 75%, preferably between 85 and 96% of the apparent volume occupied by the fabric. As illustrated, the waves extend in a vertical or inclined direction so that channels for upward free flow of gas and electrolyte are provided which channels are not substantially obstructed by the wire of the fabric. This is true even when the waves extend across the cell from one side to the other because the mesh openings in the sides of the waves permit free flow of fluids.

As described in connection with other embodiments, the end-plates 110 and 103 are clamped together and bear against membrane 105 with a gasket shielding the membrane from the outside atmosphere disposed between the end walls. The clamping pressure compresses the undulating fabric 113 against the finer screen 114 which in turn presses the membrane against the opposed anode 108*a* and this compression appears to permit a lower overall voltage.

One test was performed wherein the uncompressed fabric 113 had an overall thickness of 6 millimeters and it was found that at a current density of 3000 Amperes per square meter of projected electrode area, a voltage drop of about 150 millivolts was achieved when the compressible sheet was compressed to a thickness of 4 millimeters and also to 2.0 millimeters over that observed for the same current density at zero compression.

Between zero and compression to 4 millimeters, a comparable voltage drop of 5 to 150 millivolts was observed. The cell voltage remained practically constant down to a compression to about 2.0 millimeters and started to rise slightly as compression went belong 2.0 millimeters, that is to about 30% of the original thickness of the fabric. This represented a substantial power saving which may be 5 or more percent for the brine electrolysis process.

In the operation of this embodiment, substantially saturated aqueous sodium chloride solution was fed into the bottom of the cell and flowed upward through channels or spaces 106 between ribs 109 and depleted brine and evolved chlorine escaped from the top of the cell. Water or dilute sodium hydroxide was fed into the bottom of the cathode chambers and rose through channels 111 as well as through the voids of the compressed mesh sheet 113. Evolved hydrogen and alkali were withdrawn from the top of the cell. Electrolysis was effected by imparting a direct current electric potential between the anode and cathode end plates.

FIG. 7 is a diagrammatic vertical cross-sectional fragment which illustrates the flow pattern of this cell. At least the upper openings in pressure plate 122 are lowered to provide an inclined outlet directed upwardly away from the compressed fabric 113 whereby some portion of evolved hydrogen and/or electrolyte escapes to the rear electrolyte chamber III (FIG. 6). It will be seen therefore that vertical spaces at the back of the pressure plate 122 and the space occupied by compressed mesh 113 are provided for upwardcatholyte and gas flow.

By recourse to two such chambers, it is possible to reduce the gap betwen pressure plate 112 and the membrane and to increase the compression of sheet 113 while still having the sheet open to fluid flow. This serves to increase the overall effective surface area of active portions of the cathode.

Figure 8:
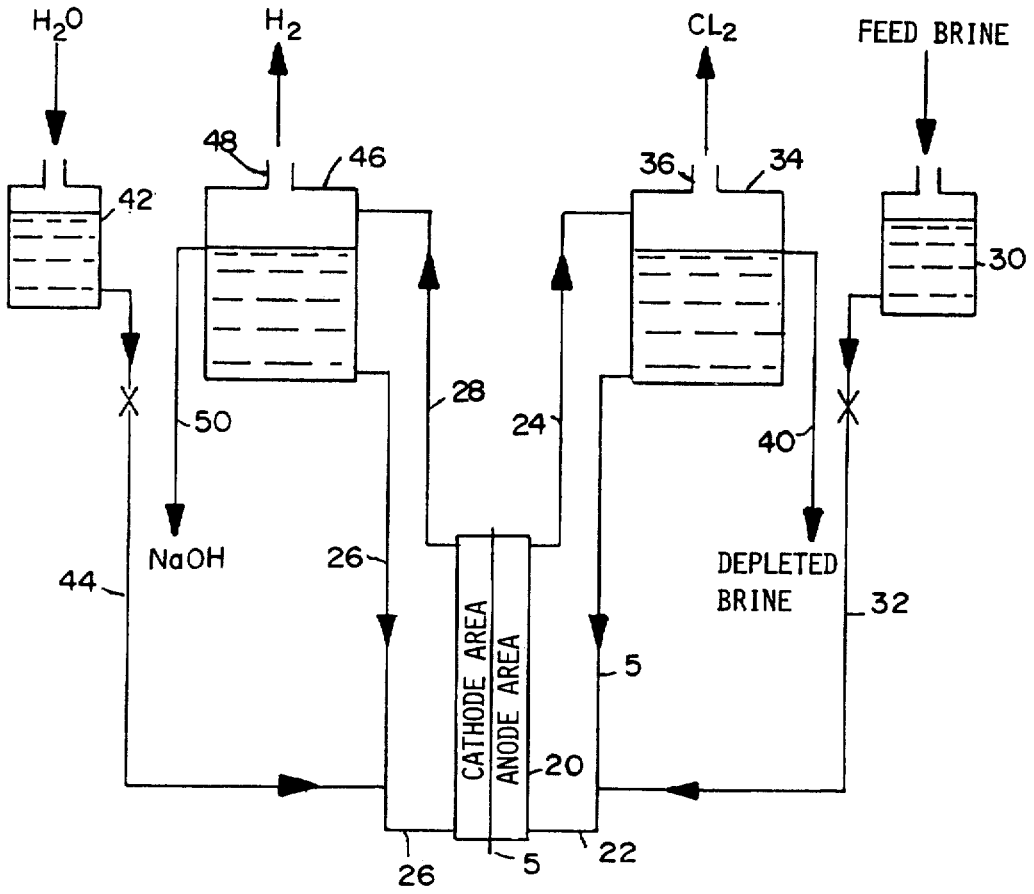
FIG. 8 is a schematic diagram illustrating the electrolyte circulation system used in connection with the cell herein contemplated.

FIG. 8 diagrammatically illustrates the manner of operating the cell herein contemplated. As shown therein, a vertical cell 20 of the type illustrated in the cross-sectional view in FIG. 5 or FIG. 6 is provided with anolyte inlet line 22 which enters the bottom of the anolyte chamber (anode area) of the cell and leaves by anolyte exit line 24 which exits from the top of the anode area. Similarly, catholyte inlet line 26 discharges into the bottom of the catholyte chamber of cell 20 and the cathode area has an exit line 28 located at the top of the cathode area. The anode area is separated from the cathode area by membrane 5 having anode 8 pressed on the anode side and cathode 14 pressed on the cathode side (see FIGS. 4 or 5). The membrane electrode extends in an upward direction and generally, its height ranges from about 0.4 to 1 meter or higher.

The anode chamber or area is bounded by the membrane and anode on one side and the anode end wall 6 (see FIGS. 4 or 5) on the other, while the cathode area is bounded by the membrane and the cathode on one side and the upright cathode end wall on the other. In the operation of the system, the aqueous brine is fed from a feed taken 30 into line 22 through a valved line 32 which runs from tank 30 to line 22 and a recirculation tank 34 is provided and discharges brine from a lower part thereof through line 5. The brine concentration of the solution entering the bottom of the anode area is controlled to be at least close to saturation by proportioning the relative flows through line 32 and the brine entering the bottom of the anode area flows upward and in contact with the anode. Consequently, chlorine is evolved and rises with the anolyte and both are discharged through line 24 to tank 34 where the chlorine is separated and escapes as indicated through exit port 36. The brine is collected in tank 34 and is recycled and some portion of this brine is withdrawn as depleted brine through overflow line 40 and sent to a source of solid alkali metal halide for resaturation and purification.

Alkaline earth metal in the form of halide or other compounds is held at low concentrations well below one part per million parts of alkali metal halide and frequently as low as 50 to 100 parts of alkaline earth metal per billion parts by weight of alkali halide.

On the cathode side, water is fed to line 26 from a tank or other source 42 through line 44 which discharges into recirculating line 26 where it is mixed with recirculating alkali metal hydroxide (NaOH) coming through line 26 from the recirculation tank. The water-alkali metal hydroxide mixture enters the bottom of the cathode area and rises toward the top thereof through the compressed gas permeable mat 13 (FIG. 5) or current collector. During the flow, it contacts cathode 7 and hydrogen gas as well as alkali metal hydroxide are formed. The cathode liquor is discharged through line 28 into tank 46 where hydrogen is separated through port 48 and alkali metal hydroxide solution is withdrawn through line 50. Water fed through line 44 is controlled to hold the concentration of NaOH or other alkali at the desired level. This concentration may be as low as 5 to 10% alkali metal hydroxide by weight but normally, this concentration is above about 15%, preferably in the range of 15 to 40 percent by weight.

Since gas is evolved at both electrodes, it is possible and indeed advantageous to take advantage of the gas lift properties of evolved gases which is accomplished by running the cell in a flooded condition and holding the anode and cathode electrolyte chambers relatively narrow, for example, 0.5 to 8 centimeters in width. Under such circumstances, evolved gas rapidly rises carrying the electrolyte therewith and slugs of electrolyte and gas are discharged through the discharge pipes into the recirculating tanks. This circulation may be supplemented by pumps, if desired.

Knitted metal fabric which is suitable for use as the current collector of the invention is manufactured by Knitmesh Limited, a British Company having an office at South Croydon, Surrey and the knitted fabric may vary in size and degree of fineness. Wire conveniently used ranges from 0.1 to 0.7 millimeters, although larger or smaller wires may be resorted to and these wires are knitted to provide about 2.5 to 20 stitches per inch (1 to 4 stitches per centimeter), preferably in the range of about 8 to 20 stitches of openings per inch, (2 to 4 openings per centimeter). Of course, it will be understood that wide variations are possible and thus, undulating wire screen having a fineness ranging from 5 to 100 mesh may be used.

The interwoven, interlaced or knitted metal sheets are crimped to provide a repeating wavelike contour or are loosely woven or otherwise arranged to provide thickness to the fabric which is 5 to 100 or more times the diameter of the wire. Thus, the sheet is compressible but because the structure is interlaced and movement is restricted by the structure, elasticity of the fabric is preserved. This is particularly true when it is crimped or corrugated in an orderly arrangement of spaced waves such as in a herring bone pattern. Several layers of this knitted fabirc may be superimposed if desired.

When helix construction illustrated in FIG. 3 is resorted to, the wire helices should be elastically compressible. The diameter of the wire and the diameter of the helices are such as to provide the necessary compressibility and resiliency and the diameter of the helix is generally 10 or more times the diameter of the wire in its uncompressed condition. For example, 0.6 mm diameter nickel wire wound in helices of about 10 mm diameter has been used satisfactorily.

Nickel wire is suitable when the wire is cathodic as has been described above and illustrated in the drawings. However, any other metal capable of resisting cathodic attack or corrosion by the electrolyte or hydrogen embrittlement may be used. These may include stainless steel, copper, silver coated copper or the like.

While in the embodiments described, above, the compressible collector is shown as cathodic, it is to be understood that the polarity of the cells may be reversed so that the compressible collector is anodic. Of course, in that event the electrode wire must resist chlorine and anodic attack and accordingly, the wires may be made of a valve metal such as titanium or niobium, preferably coated with an electroconductive, non passivating layer resistant to anodic attack such as platinum group metal or oxide, bimetallic spinel, perovskite etc.

Application of the compressible member to the anode side may in some cases create a problem because halide electrolyte supply to the electrode-membrane interface may be restricted. When the anodic areas do not have sufficient access to the anolyte flowing through the cell, the halide ion concentration may become reduced in local areas due to the electrolysis and, when it is reduced to too great an extent, oxygen rather than halogen tends to be evolved as a result of water electrolysis. This is accomplished by maintaining the the areas of points of electrode-membrane contact small i.e. rarely more than 1.0 millimeters and often less one/half millimeter in width and it can also be effectively accomplished by maintaining a screen of relatively fine mesh, 50 mesh or greater, between the compressible mat and the membrane surface.

Although these problems are also important on the cathode, less difficulty is encountered since the cathodic reaction is to evolve hydrogen and there is no occurence of side reaction. The products are generated even though the points of contact are relatively large because water and the alkali metal ion migrate through the membrane and even if the cathode presents one restriction, an amount of by product formation is less likely to occur. Therefore, it is advantageous to apply the compressible mat to the cathode side.

In the following examples there are described several preferred embodiments to illustrate the invention. However, it is to be understood that the invention is not intended to be limited to the specific embodiments.

EXAMPLE 1

A first test cell (A) was constructed according to the schematic illustration shown in FIGS. 6 and 7. Dimensions of the electrodes were 500 mm in width and 500 mm in height and the cathodic end plate 110, cathodic ribs 120 and the cathodic foraminous pressure plate 122 were made of steel galvanically coated with a layer of nickel. The foraminous pressure plate was obtained by slitting a 1.5 mm thick plate of steel forming diamond shaped apertures having their major imensions of 12 and 6 mm. The anodic end plate 103 was made of titanium cladded steel and the anodic ribs 109 were made of titanium.

The anode was comprised of a coarse, substantially rigid expanded metal screen of titanium 108 obtained by slitting a 1.5 mm thick titanium plate forming diamond shaped apertures having their major dimensions of 10 and 5 mm, and a fine mesh screen 108*a* of titanium obtained by slitting a 0.20 mm thick titanium sheet forming diamond shaped apertures having their major dimensions of 1.75 and 3.00 mm spot welded on the inner surface of the coarse screen. Both screens were coated with a layer of mixed oxides of ruthenium and titanium corresponding to a load of 12 grams of ruthenium (as metal) per square meter of projected surface.

The cathode was comprised of three layers of crimped knitted nickel fabric forming the resilient mat 113 and the fabric was knitted with nickel wire with a diameter of 0.15 mm. The crimping had a herringbone pattern, the wave amplitude of which was 4.5 mm and the pitch between adjacent crest of waves was 5 mm. After a pre-packing of the three layers of the crimped fabric carried out by superimposing the layers and applying a moderate pressure, in the order of 100 to 200 $g/cm^2$, the mat assumed an uncompressed thickness of about 5.6 mm. That is, after relieving the pressure, the mat returned elastically to a thickness of about 5.6 mm. The cathode also contained a 20 mesh nickel screen 114 formed with nickel wire having a diameter of 0.15 mm whereby the screen provided about 64 points of contact per square centimeter with the surface of the membrane 105 verified by obtaining impressions over a sheet of pressure sensitive paper. The membrane was a hydrated film, 0.6 mm thick, of a Nafion 315 cation exchange membrane produced by Du Pont de Nemours i.e. a perfluorocarbon sulfonic acid type of membrane.

A reference test cell (B) of the same dimensions was constructed and the electrodes were formed according to normal commercial practice, with the two coarse rigid screens 108 and 122 described above directly abutting against the opposite surface of the membrane 105 without the use of either the fine mesh screens 108*a* and 114 and without being resiliently pressed against the membrane by the compressible mat 113. The test circuits were similar to the one illustrated in FIG. 8.

The operating conditions were as follows:

| | |
|---|---|
| inlet brine concentration | 300 g/l of NaCl |
| outlet brine concentration | 180 g/l of NaCl |
| temperature of anolyte | 80° C. |
| pH of anolyte | 4 |
| caustic concentration in catholyte | 18% by weight of NaOH |
| current density | 3000 A/m$^2$ |

Figure 9:
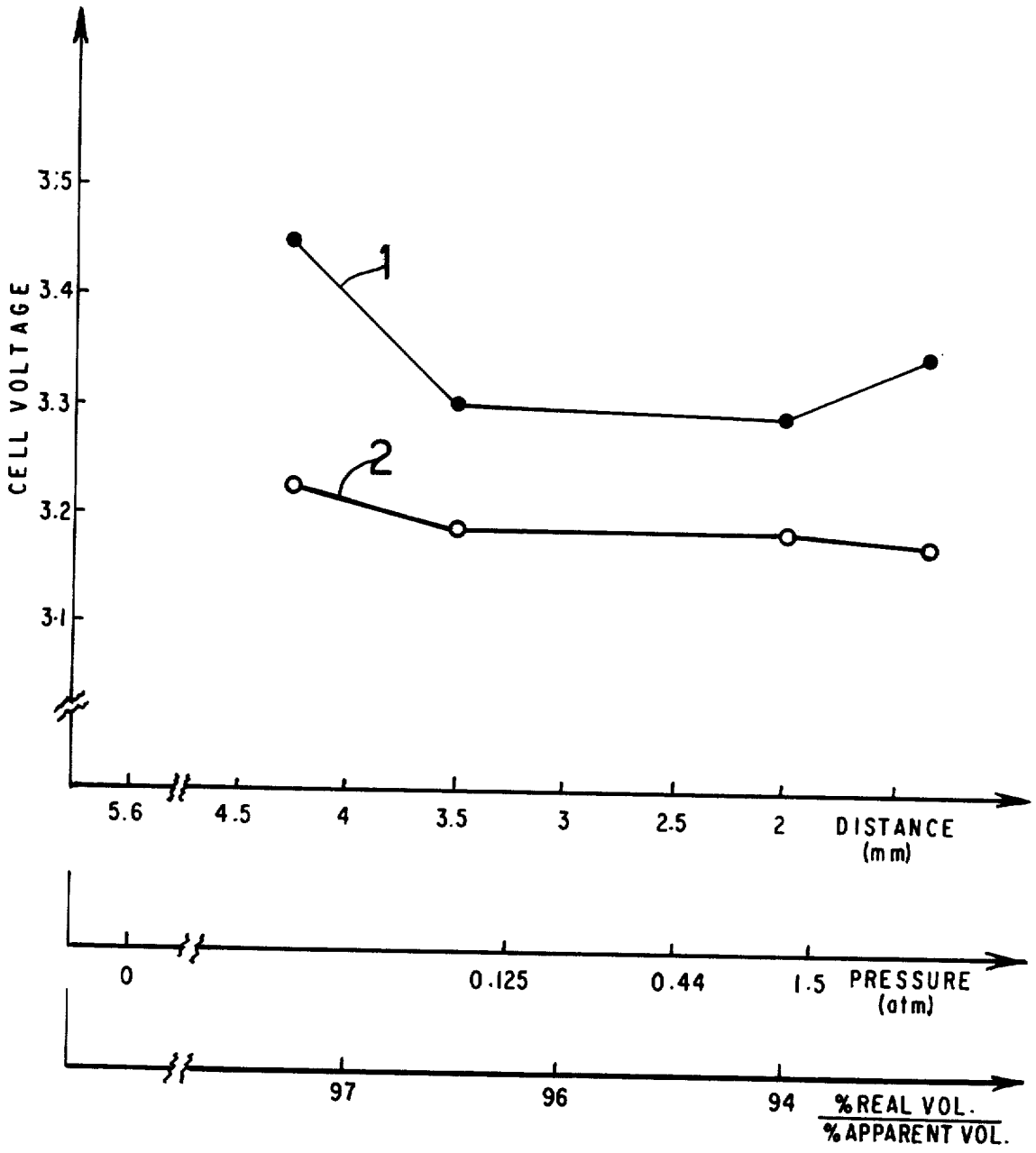
FIG. 9 is a graph comparing the voltages of a cell of the invention with different degrees of compression as discussed in the examples.

Test cell (A) was put in operation and the resilient mat was increasingly compressed to relate the operating characteristics of the cell, namely cell voltage and current efficiency, to the degree of compression. In FIG. 9, curve 1 shows the relation of cell voltage to the degree of compression or the corresponding pressure applied. It is observed that the cell voltage decreased with increasing compression of the resilient mat down to a thickness corresponding to about 30% of the original uncompressed thickness of the mat. Beyond this degree of compression, the cell voltage tended to rise slightly.

By reducing again the degree of compression to a mat thickness of 3 mm, the operation of the cell A compared with that of parallely operated reference cell B shown the following results:

| | Cell Voltage V | Cathodic Current Efficiency % | $O_2$ in $Cl_2$ % by volume |
|---|---|---|---|
| Test cell A | 3.3 | 85 | 4.5 |
| Test cell B | 3.7 | 85 | 4.5 |

In order to have an assessment of the contribution of the bubble effect on the cell voltage, the cells were rotated first 45° and finally 90° from the vertical with the anode remaining horizontally on top of the membrane. The operating characteristics of the cells are reported hereinbelow:

| | Inclination (°) | Cell Voltage V | Cathodic Current % | $O_2$ in $Cl_2$ % by vol. |
|---|---|---|---|---|
| Test cell A | 45 | 3.3 | 85 | 4.4 |
| Reference cell B | 45 | 3.65 | 85 | 4.4 |
| Test cell A | horizontal | 3.3 (x) | 86 | 4.3 |
| Reference cell B | " | 3.6 (xx) | 85 | 4.5 |

(x) The cell voltage started slowly to rise and stabilized at about 3.6 V.
(xx) The cell voltage rose abruptly to well over 12 V and electrolysis was therefore interrupted.

These results are interpreted as follows: (a) by rotating the cells from the vertical and towards the horizontal orientation, the bubble effect contribution to the cell voltage decreases in cell B, while the relative in-sensitivity of cell A is apparently due to a substantially negligeable bubble effect which would in part explain the much lower cell voltage of cell A with respect to cell B. (b) Upon reaching the horizontal position, the hydrogen gas begins to pocket under the membrane and tends to insulate more and more the active surface of the cathode screen from ionic current conduction through the catholyte in the reference cell B, while the same effect is outstandingly lower in the test cell A. This can only be explained by the fact that a major portion of the ionic conduction is limited to within the thickness of the membrane and the cathode provides sufficient contact points with the ion exchange groups on the membrane surface to effectively support the electrolysis current.

It has been found that by increasingly reducing the density and fineness of the contact points between the electrodes and the membrane by replacing the fine mesh screens 108*a* and 114 with coarser and coarser screens, the behaviour of the test cell A approaches more and more that of the reference cell B. Moreover, the resiliently compressible cathode layer 113 insures a coverage of the membrane surface with the densely distributed fine points consistently above 90% and more often above 98% of the entire surface even in presence of substantial deviations from planarity and parallelism of the compression plates 108 and 122.

EXAMPLE 2

For comparison purposes, test cell A was opened and membrane 105 was replaced by a similar membrane carrying a bonded anode and a bonded cathode. The anode was a porous, 80 μm thick layer of particles of mixed oxides of ruthenium and titanium with a Ru/Ti ratio of 45/55 being polytetrafluoroethylene (PTFE) bonded to the surface of the membrane. The cathode was a porous, 50 μm thick layer of particles of platinum black and graphite in a weight ratio of 1/1 being PTFE bonded to the opposite surface of the membrane.

The cell was operated under exactly the same conditions of Example 1 and the relation between the cell voltage and the degree of compression of the resilient cathode layer 113 is shown by curve 2 on the diagram of FIG. 9. It is significant that the cell voltage of this truly solid electrolyte cell is only approximately 100 to 200 mV lower than that of test cell A under the same operating conditions.

EXAMPLE 3

To verify unexpected results, test cell A was modified by replacing all the anodic structures made of titanium with comparable structures made of nickel coated steel (anodic end plate 103 and anodic ribs 109) and pure nickel (coarse screen 108 and fine mesh screen 108*a*). The membrane used was a 0.3 mm thick cation exchange membrane Nafion 120 manufactured by Du Pont de Nemours.

Pure twice-distilled water having a resistivity of more than 200,000Ω cm was circulated in both the anodic and cathodic chambers. An increasing difference of potential was applied to the two end plates of the cell and an electrolysis current started to pass with oxygen being evolved on the nickel screen anode 108*a* and hydrogen being evolved on the nickel screen cathode 114. After a few hours of operation, the following voltage-current characteristics were observed:

| Current Density A/m² | Cell Voltage V | Temperature of Operation °C. |
|---|---|---|
| 3000 | 2.7 | 65 |
| 5000 | 3.5 | 65 |
| 10,000 | 5.1 | 65 |

The conductivity of the electrolytes being insignificant, the cell proved to operate as a true solid electrolyte system.

By replacing the fine mesh electrode screens 108*a* and 114 with coarser screens, thereby reducing the density of contacts between the electrodes and the membrane surface from 100 points/cm² to 16 points/cm²; a dramatic rise of the cell voltage was observed as reported hereinbelow:

| Current Density A/m² | Cell Voltage V | Temperature of Operation °C. |
|---|---|---|
| 3000 | 8.8 | 65 |
| 5000 | 12.2 | 65 |
| 10,000 | — | — |

As will be obvious to the skilled in the art, it is possible to increase the density of contact points between the electrodes and the membrane by means of various expedients. For example, the fine electrodic mesh screen may be sprayed with metal particles through plasma jet deposition, or the metal wire forming the surface in contact with the membrane may be made coarser through a controlled chemical attack to increase the density of contact points. Nevertheless, the structure must be sufficiently pliable to guarantee an even distribution of contacts over the entire surface of the membrane so that the elastic reaction pressure exerted by the resilient mat to the electrodes is evenly distributed to all the contact points.

The electric contact at the interface between the electrodes and the membrane may be improved by increasing the density of functional ion exchange groups, or by reducing the equivalent weight of the copolymer on the surface of the membrane in contact with the resilient mat or the intervening screen or particulate electrode. In this way, the exchange properties of the diaphragm matrix remain unaltered and it is possible to increase the contact points density of the electrodes with the sites of ion transport to the membrane. For example, the membrane may be formed by laminating one or two thin films having a thickness in the range of 0.05 to 0.15 mm of copolymer exhibiting a low equivalent weight, over the surface or surfaces of a thicker film, in the range of 0.15 to 0.6 mm, of a copolymer having a higher equivalent weight, or a weight apt to optimize the ohmic drop and selectively of the membrane.

Various other modifications of the method and apparatus of the invention may be made without departing from the spirit or scope thereof and it is to be understood that the invention is to be limited only as defined in the appended claims.

I claim:

1. A method of generating halogen by electrolysis of halide electrolyte in an electrolytic cell having an anode and a cathode separated by a semi-permeable membrane characterized in that both electrodes are open to gas and electrolyte flow and have a surface in direct contact at a plurality of points with the surface of the membrane, wherein the density of the points of contact is at least 30 points/cm² and the ratio between the total contact area and the projected area is not more than 75% and a substantially uniform resilient pressure is maintained over the points of contact the electrode surfaces in contact at a plurality of points with the surface of the membrane comprise thin, electrically conductive screens slideable with respect to the membrane and having a mesh number of at least 10.

2. The method of claim 1 wherein the resilient pressure applied to the electrodes is 50 to 2000 g/cm².

3. A method of generating halogen by electrolyzing halide electrolyte which comprises electrolyzing the halide electrolyte between a pair of oppositely charged electrodes which are in contact with and extend along opposite sides of an ion permeable membrane, at least one of said electrodes having a surface in direct contact with the diaphragm and comprising a relatively fine flexible gas and electrolyte permeable screen having an electroconductive surface bearing against the diaphragm; a coarser electroconductive compressible mat behind and bearing against the flexible screen, said mat being open to electrolyte and gas flow and a more rigid section behind the mat and said mat and more rigid section being substantially coextensive with a major area of the flexible screen holding the flexible screen against the diaphragm by pressure applied to the more rigid section and supplying electrolyte to said flexible screen, at least one of said electrodes being maintained in contact with halide electrolyte.

4. The method of claim 3 wherein said more rigid section is electrolyte and gas permeable and a body of electrolyte is maintained behind the more rigid section from which electrolyte may be supplied to the flexible screen in contact with the diaphragm.

5. The cell of claim 3 wherein at least one electrode of the cell has a porous structure open to electrolyte and gas flow and an electrically conductive surface substantially in contact at a plurality of points with the diaphragm surface.

6. The method of claim 3 where membrane has particulate material bonded to the surface thereof in contact with the fine screen.

7. The method of claim 3 whereas the screen and fine screen and fabric are cathodic and aqueous alkali metal halide is maintained in contact with the anode and aqueous alkali is maintained flowed through the fabric.

8. The method of claim 7 wherein the membrane and electrode are upwardly aligned and aqueous alkali is circulated through the fabric from a layer portion of a higher portion thereof.

9. A method of generating halogen by electrolyzing aqueous halide between an electrode and counter electrode separated by an ion permeable diaphragm sheet and electrode and counter electrode extending along said sheet and in contact with opposite sides thereof; said counter electrode comprising a substantially rigidly mounted layer; said electrode compressing a resiliently compressible electroconductive mat which is open to edgewise flow of electrolyte and gas therethru maintaining an aqueous alkali metal halide extending along and in contact with one of said electrode compressing said electrode to squeeze the electrodes and diaphragm together while maintaining the electrode sufficiently open to permit said edgewise flow and flowing electrolyte edgewise through the electrode.

10. The method of claim 9 wherein said compressible mat comprises an open mesh wire network having open mesh which extends transversely across the path of edgewise electrolyte flow whereby said flow can occur edgewise through openings of said mass.

11. The method of claim 9 wherein the compressible mat comprises undulating wire mesh fabric.

12. The method of claim 9 wherein the fabric is compressed 10% or more or its uncompressed thickness and has a free volume not substantially less than 50% of the fabric volume.

13. A method of generating halogen by electrolyzing an aqueous halide which comprises conducting the electrolysis in a cell having an anode compartment and a cathode compartment separated by a flexible ion permeable diaphragm having oppositely charged electrodes extending along and in contact with opposite sides of the diaphragm, at least one of said electrodes comprising a resilient compressible electro-conductive metal fabric open to electrolyte and gas flow and moveable with respect to the compressing surfaces capable when compressed of applying pressure to the diaphragm and of distributing pressure laterally along the diaphragm, compressing the metal fabric substantially below its uncompressed thickness and sufficient to cause said pressure distribution while restraining diaphragm displacement from the opposite side thereof, maintaining the metal fabric open to flow of electrolyte and gas along the diaphragm, flowing aqueous halide through the anode compartment and maintaining the cathode in contact with aqueous alkali.

14. The method of claim 13 wherein the diaphragm and metal fabric are upwardly aligned and the fabric comprises wrinkled electroconductive wire which is open to upward gas and electrolyte flow along the diaphragm.

15. The method of claim 14 wherein the compressible metal fabric comprises crimped or wrinkled knitted mesh.

16. The method of claim 14 wherein the compressible metal fabric comprises at least two superimposed layers of undulating wire mesh.

17. The method of claim 13 wherein the metal fabric is compressed 10% or more of its uncompressed thickness.

18. The method of claim 17 wherein the compressed metal fabric has a free volume open to electrolyte flow of not substantially less than 50% of the volume of the metal fabric.

19. The method of claim 13, 14, 15, 16, 17 or 18 wherein the metal fabric is cathodic.

20. The method of claim 13 wherein the electrode surface in direct contact with the surface of the diaphragm is a thin, flexible, screen made of an electroconductive and corrosion resistant metal slideable with respect to the surface of the diaphragm and to the resiliently compressible layer and which is less compressible than the said layer.

21. The method of claim 20 wherein the surface in direct contact at a plurality of points with the diaphragm has a density of points of at least 30 points per square centimeter and wherein the ratio between the total contact area and the area of the diaphragm is lower than 75%.

22. The method of claim 21 wherein the ratio between the total contact area and the area of the diaphragm is in the range of 25 to 40%.

23. The method of claim 13 wherein the electrode resiliently compressible against the diaphragm is the cathode.

24. The method of claim 13 wherein the counter-electrode of the cell is substantially rigid and comprises a surface in direct contact at a plurality of points with the diaphragm.

25. The process of claim 13 wherein an aqueous solution of alkali metal chloride is fed to the anode and an aqueous solution of alkali metal hydroxide is kept in contact with the cathode.

26. The process of claim 13 wherein the diaphragm is a polymeric cation permeable and electrolyte and gas impervious membrane.

27. The process of claim 13 wherein the resiliently compressible layer open to the electrolyte has a ratio of empty spaces and the volume apparently occupied by the compressed resilient layer of at least 50%.

28. The method of claim 27 wherein the ratio is in the range of 85 and 96%.

29. The method of claim 13 wherein the pressure applied to the resilient layer is between 50 and 2000 $g/cm^2$.

30. A method of generating halogen comprising electrolyzing an aqueous halide electrolyte at an anode separated from a cathode by a flexible ion permeable diaphragm and an electrolyte at the cathode, at least one of said anode and cathode having a gas and electrolyte permeable surface in contact with the diaphragm and a compressed resiliently compressible layer of metal wire fabric moveable with respect to the compressing surfaces open to electrolyte flow and capable of applying pressure to said surface and of distributing pressure laterally whereby the contact pressure on the surface of the diaphragm is substantially uniform.

31. The method of claim 30 wherein the metal fabric comprises undulating wire.

32. The method of claim 30 or 31 wherein the compressible layer comprises a plurality of layers of said metal fabric.

33. The method of claims 13 or 30 wherein the electrode is an intervening porous layer of electroconductive and corrosion resistant material bonded to or otherwise incorporated in direct contact with the diaphragm.

34. A method of generating halogen by electrolyzing an aqueous halide comprising conducting said electrolysis in a cell having an upright aligned ion permeable diaphragm having a conductive gas and electrolyte permeable electrode bearing against one side of the diaphragm and a counter electrode on the other side of the diaphragm and first electrode comprising a resiliently compressible electroconductive wire mat which is open to upward movement of gas and electrolyte therethrough a more rigid electrolyte permeable pressure plate moveable with respect to the mat and adapted to press the mat against the diaphragm and rear electrolyte space permitting upward flow of electrolyte flowing electrolyte and evolved gas upward through the mat permitting a portion of the electrolyte to flow into the rear electrolyte space.

35. The method of claim 34 wherein the mat is a cathode and evolved hydrogen is withdrawn from the upper part of the mat and from the rear electrolyte space feeding alkali metal halide to the anode and alkali to the mat.

36. A method of generating halogen by electrolysis of an aqueous alkali metal halide which comprises conducting the electrolysis in a cell having an upright ion exchange membrane sheet with a pair of upright opposed gas and electrolyte permeable electrodes extending along opposite sides of the membrane, the cathode having an electroconductive surface in contact with the membrane and comprising an electrolyte and gas permeable compressible wire mat, compressing the mat against the membrane and more rigidly supporting the membrane on the opposite side thereof to hold the diaphragm and to squeeze the diaphragm, the electrode surface and the mat together, flowing alkali metal halide along the anode and flowing aqueous alkali edgewise through the mat and along the membrane and permitting cathodic gas to rise edgewise through the mat.

37. A method of electrolyzing an aqueous halide which comprises conducting the electrolysis in a cell having an ion permeable diaphragm dividing the cell and oppositely charged gas permeable electrodes in contact with opposite sides of the diaphragm at least one of said electrode being compressible and comprising an electrolyte permeable electroconductive screen bearing against the diaphragm and a compressible wire mat behind the screen and compressing the mat against the screen and circulating electrolyte through the compressible electrode.

38. The method of claim 37 wherein the compressible electrode is the cathode and aqueous halide is circulated in contact with the anode.

39. Electrolysis cell comprising a cathode and an anode separated by a flexible diaphragm, characterized in that at least one electrode of the cell comprises a resiliently compressible layer of open metal fabric, coextensive with the other electrode, said layer, compressible against the diaphragm, exerting an resilient reaction force on to the diaphragm and is capable of transferring the excess pressure acting on a single contact point to less charged adjacent points, laterally along whatever axis lying in the plane of the resilient layer so that said resilient layer distributes the pressure over the entire electrode surface and said compressed resilient layer has a structure open to electrolyte and gas flow, means moveable with respect to resilient layer to compress the resilient layer and means to feed liquid electrolyte through the compressed layer and a rigid support on the other side of the flexible diaphragm to restrain diaphragm displacement.

40. The cell of claim 39 wherein the resiliently compressible layer is metallic.

41. The cell of claim 39 wherein the resiliently compressible layer consists of fabric of crimped woven metal wire.

42. The cell of claim 39 wherein the resiliently compressible layer consists of a series of helicoidal coils made of metal wire.

43. The cell of claim 39 wherein the electrode surface in contact with the surface of the diaphragm comprises a porous and permeable layer of particles of an electrically conductive and corrosion resistant material bonded onto the diaphragm surface.

44. The cell of claim 39 wherein the electrode surface in contact with the surface of the diaphragm is thin, pliable screen of an electrically conductive material slideable along the diaphragm surface.

45. The cell of claim 39 wherein the counter-electrode of the cell is substantially rigid and comprises a surface in contact at a plurality of points with the diaphragm surface.

46. The cell of claim 39 wherein the electrode surface in contact at a plurality of points with the diaphragm surface as a density of points of contact of at least 30 points/cm$^2$ and the ratio between the total contact area and the diaphragm area is lower than 75%.

47. The cell of claim 46 wherein the ratio between the total contact area and the diaphragm area is 25 to 40%.

48. The cell of claim 39 wherein the resiliently compressible layer open to the electrolyte and gas flow has a ratio between empty spaces and the apparent volume of the compressed resilient layer higher than 50%.

49. The cell of claim 48 wherein the ratio is between 85 and 96%.

50. The cell of claim 39 wherein the compressed resilient layer exerts a pressure against the diaphragm of 50 to 2000 g/cm$^2$.

51. The cell of claim 39 wherein the means to compress the layer is capable of compressing the layer at least 10% of its thickness.

52. An electrolytic cell for electrolyzing aqueous electrolyte which comprises a cell unit divided by an ion permeable diaphragm sheet into compartments, a pair of opposed electrodes on opposite sides of the diaphragm and extending therealong, at least one of said electrodes being gas and electrolyte permeable and in contact with the diaphragm, an electrolyte and gas permeable resiliently compressible electroconductive mat behind and in contact with one electrode, means to resiliently compress the mat against the electrode, more rigid means to resist the compression on the opposite side of the diaphragm whereby to hold the diaphragm in place and to squeeze the mat electrode surface and diaphragm together and means to flow liquid electrolyte through each cell compartment.

53. The cell of claim 52 wherein an electroconductive screen is interposed between the mat and the diaphragm.

54. An electrolysis cell for electrolyzing aqueous electrolyte which comprises a cell unit divided by an ion permeable diaphragm into an electrode compartment and a counterelectrode compartment, an electrode on one side and a counter eelectrode on the other side of the diaphragm and extending along the diaphragm, at least the electrode being gas and electrolyte permeable and in contact with the diaphragm, said electrode comprising a relatively uncompressible screen adjacent to the diaphragm, said screen being electroconductive and having an electroconductive resiliently compressible mat open to electrolyte and gas flow engaging the rear of the screen and adapted to resiliently squeeze the screen against the diaphragm means to compress the mat against the screen and means to flow electrolyte through the mat and along the screen.

55. The cell of claim 54 wherein the electrode comprises a gas and electrolyte permeable electrode layer bonded to the diaphragm and between the screen and the diaphragm.

56. An electrolytic cell which comprises an ion permeable diaphragm, an electrode having a conductive and gas and electrolyte permeable surface in direct contact with and extending along one side of said diaphragm, a counter electrode disposed on the other side of said diaphragm, said electrode comprising an electroconductive screen bearing against the diaphragm, a coarser compressible electroconductive mat behind and bearing against the finer screen, said mat being open to electrolyte and gas flow, a more rigid backwall adapted to press the mat against the screen, an electrolyte space behind the backwall, and means to circulate electrolyte through said space.

57. The cell of claim 56 wherein the mat comprises undulating wire mesh providing an electrolyte space within the mat.

58. An electrolytic cell which comprises an upright aligned ion permeable membrane sheet, an electrode having a conductive and gas and electrolyte permeable surface bearing against and extending along one side of the membrane and a counter electrode disposed on the other side of the diaphragm, said first electrode comprising a compressible electroconductive wire fabric which is open to upward movement of gas and electrolyte therethru, a more rigid electrolyte permeable pressure plate adapted to compress the mat against the membrane and an electrolyte space permitting upward flow of electrolyte behind the pressure plate.

59. The cell of claim 58 wherein the compressible electrode is a cathode and means are provided to withdraw gas from the upper part of the compressible electrode.

60. The cell of claim 59 wherein the membrane is a cation exchange membrane which restrains electrolyte flow.

61. An electrolytic cell which comprises an anode compartment and a cathode compartment separated by an upright ion exchange membrane sheet having an electrode having electroconductive surface bearing against one side of said membrane and comprising an electroconductive wire mat which is open to electrolyte and gas flow upward along the membrane and a counter electrode on the opposite side of said membrane, said wire mat having a void space of at least 50% of the volume thereof and means to cause flow of electrolyte edgewise through the mat and along the membrane.

62. The cell of claim 61 wherein the wire mat is a cathode.

63. The method of generating halogen which comprises flowing aqueous alkali metal halide through the anode compartment of the cell of claim 61, flowing aqueous alkali through the cathode wire mat and permitting evolving hydrogen to rise upward through the wire mat toward the top of the mat and withdrawing the hydrogen from the cell.

* * * * *